US005811714A

United States Patent [19]

Hull et al.

[11] Patent Number: 5,811,714

[45] Date of Patent: Sep. 22, 1998

[54] GUN MUZZLE BRAKE

[76] Inventors: Harold L. Hull, 401 Canyon Way #43, Sparks, Nev. 89434; Donald R. Gross, 210 W. 4th, Emmett, Id. 83617

[21] Appl. No.: 729,777

[22] Filed: Oct. 8, 1996

[51] Int. Cl.[6] ..... F41C 21/18

[52] U.S. Cl. ..... 89/14.3

[58] Field of Search ..... 89/14.3, 14.2

[56] References Cited

U.S. PATENT DOCUMENTS

| | | | |
|---|---|---|---|
| 4,583,445 | 4/1986 | Blair | 89/14.2 |
| 4,879,942 | 11/1989 | Cave | 89/14.3 |
| 4,930,396 | 6/1990 | Johnson | 89/14.3 |
| 4,945,812 | 8/1990 | Mazzantie | 89/14.3 |
| 5,155,291 | 10/1992 | Dabrowski | 89/14.3 |
| 5,305,677 | 4/1994 | Kleinguenther et al. | 89/14.3 |
| 5,320,022 | 6/1994 | Kimbro | 89/14.3 |
| 5,476,028 | 12/1995 | Seberger | 89/14.3 |
| 5,509,345 | 4/1996 | Cyktich | 89/14.05 |

*Primary Examiner*—J. Woodrow Eldred

[57] ABSTRACT

A muzzle brake which may be integrally formed on the end of a gun barrel or it may be an adapter which is threadably attached to substantially the end of any gun barrel of choice. The muzzle is integrally formed and includes a first interior bore which is attachable to a gun barrel and a second interior bore which is of a size and shape to slidably receive a bullet therethrough, with the muzzle brake having multiple vent ports which are so designed as to direct exiting propellant gasses in a manner that will urge the brake and gun in a forward direction, so as to reduce recoil and also simutaneously urges the brake and the gun downward, so as to reduce vertical lift.

9 Claims, 2 Drawing Sheets

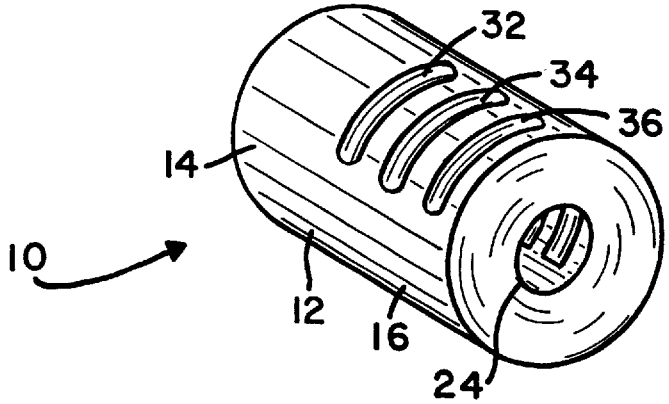
FIG. 1
FIG. 2
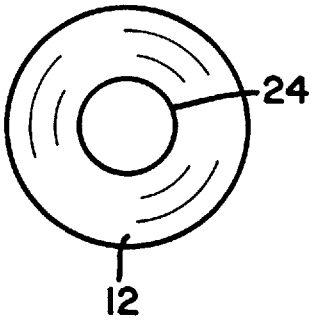
FIG. 3
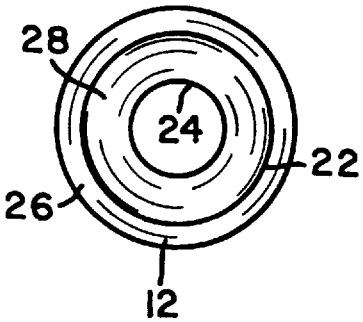

GUN MUZZLE BRAKE

FIELD OF THE INVENTION

This invention relates to gun muzzle brakes but more particularly to a gun muzzle brake which may be either integrally formed on the end of a gun barrel or it may be an integrally formed threaded adapter for attachment to a gun barrel, and provides reduced recoil and reduced vertical lift.

BACKGROUND OF THE INVENTION

In the past, muzzle brakes of various designs have been taught. However, most of these designs have inherent disadvantages, such as they are very complicated, most are not integrally formed, they are not completely effective and they are much to costly to manufacture.

It is well known in the field that the main disadvantage when firing a firearm is that undesirable recoil is most often encountered, (due to propelling gases exiting from the gun barrel) and this recoil severely interferes with accuracy when firing at a target. Therefore, numerous attempts have been made to overcome recoil and/or undesirable movement of the gun while firing. In most of these attempts, reduced recoil is achieved by forcing the propellant gases, (flowing out at the muzzle) into and throughout apertures or slits which redirect the exiting gases in a manner so as to generate a forward force on the muzzle brake, which in turn retards the backward recoil of the barrel. However, the previous attempts have proven to be ineffective and/or to complicated and costly to manufacture.

SUMMARY OF THE INVENTION

It is therefore an object of the present invention to provide a new type of gun muzzle brake which is most economical to manufacture as it may be integrally formed within the gun barrel at the point of manufacture, or it may be an integrally formed adapter which is removably attachable to the firing end of a gun barrel.

It is a further object of the present invention to provide a gun muzzle brake which includes multiple apertures therein which direct propelling gases against a ricochet surface, which in turn exerts a forward force on the gun, thus reducing recoil, while simultaneously directing the gases upwardly and to the sides, thus reducing vertical lift of the gun.

It is another object of the present invention to provide a gun muzzle brake which is adaptable so as to be threadably attachable to the barrel of substantially any gun of choice.

Still another object of the present invention is to provide a gun muzzle brake which is small in size, (when compared to the known prior art) and thus is light weight and easily portable.

Other objects and advantages will be seen when taken into consideration with the following specification and drawings.

BRIEF DESCRIPTION OF THE DRAWINGS

FIG. 1 is substantially a perspective view of the present invention.

FIG. 2 is substantially a left end view of FIG. 1.

FIG. 3 is substantially a right end view of FIG. 1.

DETAILED DESCRIPTION OF THE DRAWINGS

Figure 4:
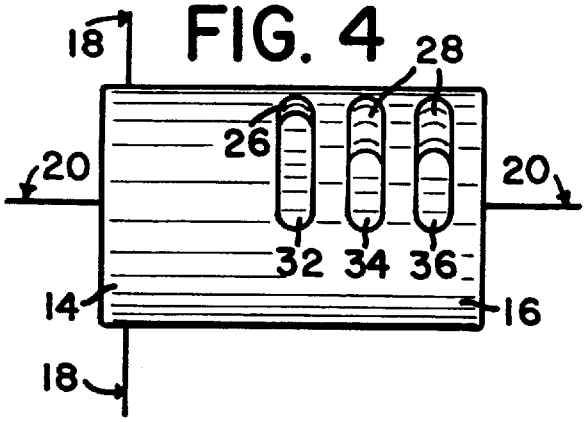
FIG. 4 is substantially a right side view of FIG. 1.

Referring now to the drawings wherein like characters refer to like elements throughout the various views. In FIG. 1, (10) represents substantially an overview of the present invention which is a firearm muzzle brake and which is so designed to reduce recoil and vertical lift while firing a gun.

Figure 5:
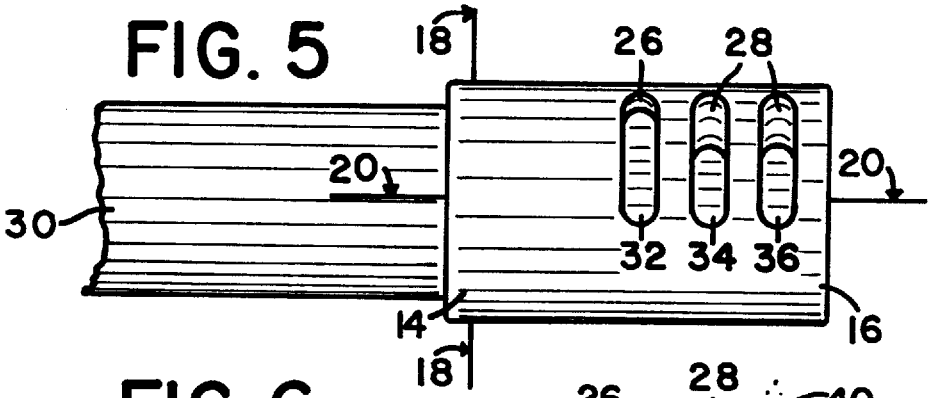
FIG. 5 is substantially a side view of FIG. 1 when attached to the end of a gun barrel.
Figure 7:
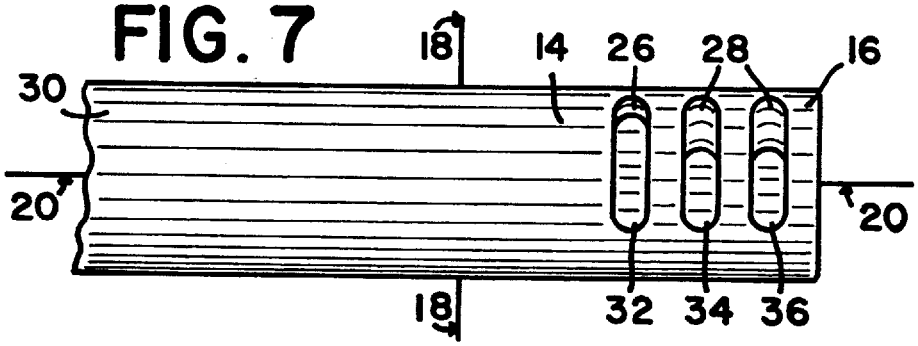
FIG. 7 is substantially a side view of the end of a gun barrel having the present invention integrally formed therein.

The firearm muzzle brake (10) is substantially an integrally formed elongated tubular member (12) which forms the brake and is integrally formed from any suitable material of engineering choice. Member (12) includes each of the following; a first half section (14); a second half section (16); a vertical axis (arrow 18) as shown in FIGS. 4, 5 & 7; a horizontal axis (arrow 20) as shown in FIGS. 4, 5 & 7; a first interior bore (22) and a second interior bore (24).

It is to be noted that first interior bore (22) is in open communication with second interior bore (24). First interior bore (22) has a side wall (26) which is thinner than the side wall (28) of second interior bore (24), as clearly seen in FIG. 3. It is to be noted that first interior bore (22) is integrally formed within first half (14) and second interior bore (24) is integrally formed within second half (16). First interior bore (22) being of a shape and size to threadably receive the barrel end (30) of a gun with second interior bore (24) being of a shape and size to slidably receive a bullet (31) therethrough, (bullet 31 is shown in FIG. 6).

Figure 6:
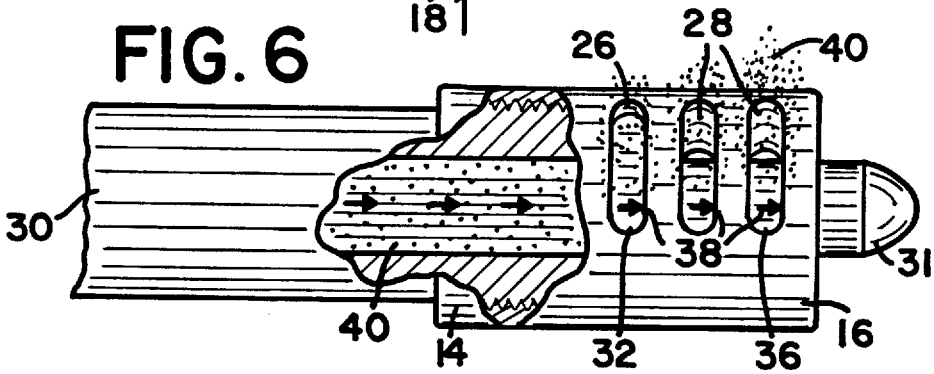
FIG. 6 is substantially a plan view for the present invention.

Referring now to FIGS. 1 and 4–7, wherein we show first bore (22) having a first pair of opposingly spaced apart vent ports (32) which extend vertically through substantially one quarter of the outside circumference of side wall (26) between first bore (22) and second bore (24). Second bore (24) having a second pair (34) and a third pair (36) of opposingly spaced apart vent ports extending vertically through substantially one quarter of the outside circumference of side wall (28) of second bore (24). Also, each of the vent ports (32), (34) & (36) include a ricochet surface, as represented in FIG. 6 by arrows (38), which is further defined in the following paragraph.

MODE OF OPERATION

Referring now to the plan view of FIG. 6, wherein it will now be seen that when member (12) is attached to the barrel end (30) of a gun and bullet (31) is fired therethrough, exiting propellant gases (40) are forcibly directed into each of the vent ports (32), (34) & (36) wherein gases (40) are then directed into each ricochet surface (arrows 38), thus causing member (12) and gun barrel (30) to be urged in a forward direction so as to reduce recoil, and gasses (40) are thereafter directed upward and out through the sides of ports (32), (34) & (36), thus causing member (12) and gun barrel (30) to be urged in a downward direction so as to reduce vertical lift.

It is to be noted that if so desired, muzzle brake (10) may be integrally formed on the front end of gun barrel (30), as shown in FIG. 7.

It will now be seen that we have herein provided a gun muzzle brake which is most economical to manufacture and which is easily marketable.

It will further be seen that we have herein provided a gun muzzle brake which includes substantially multiple ricochet surfaces which when propellant gases ricochet therefrom will urge the brake member and the gun barrel in a forward direction, thus reducing recoil.

It will also be seen that we have herein provided a gun muzzle brake which includes uniquely shaped vent ports which when propellant gasses exit therefrom, will urge the brake member and the gun barrel in a downward direction so as to reduce vertical lift when firing the gun.

It will be seen that we have herein provided a gun muzzle brake which is substantially attachable to any firearm of choice.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

We claim:

1. A firearm muzzle brake comprising:

substantially an integrally formed elongated tubular member which forms said brake, said member having;

substantially a first half section;

a second half section;

a vertical axis;

a horizontal axis;

an outside diameter;

a first interior bore; and a second interior bore;

said first half section and said second half section being substantially equal in length, said first interior bore being in open communication with said second interior bore with said first interior bore having a thinner side wall than the side wall of said second interior bore, said first interior bore being integrally formed within said first half, said second interior bore being integrally formed within said second half, said second interior bore being of a shape and size to slidably receive a bullet there through, said first bore having a first pair of opposingly spaced apart vertical vent ports, said second bore having a second and a third pair of opposingly spaced apart vertical vent ports, and said vent ports being positioned to only allow exhaust gas to exit in a sideways and upward direction so as to reduce recoil and vertical lift.

2. The muzzle brake of claim 1 is an integral part of a gun barrel.

3. The muzzle brake of claim 1 includes said first interior bore being of a shape and size to threadably receive the barrel end of a gun.

4. The muzzle brake of claim 1 includes said vertical vent ports being substantially horizontally aligned.

5. The muzzle brake of claim 1 wherein said thinner side wall forms an interior diameter for said first pair of vent ports, and said side wall of said second interior bore forms an interior diameter, for both said second and said third vent ports;

whereby;

said second and said third vent ports have the same said interior diameter.

6. The muzzle brake of claim 1 includes only two different sized interior diameters.

7. The muzzle brake of claim 1 wherein each said pair of opposingly spaced apart vertical vent ports have an overall length which is substantially equal to one half of said outside diameter.

8. The muzzle brake of claim 1 wherein each said vent port is substantially equal to one quarter of said outside diameter.

9. The muzzle brake of claim 1 wherein said opposingly spaced apart vent ports provide a connecting surface within each said pair, and when exiting propellant gases are forcibly directed against said connecting surface, said firearm is urged in a forward direction so as to reduce recoil.

* * * * *